US006045658A

United States Patent [19]

Alheid

[11] Patent Number: 6,045,658

[45] Date of Patent: Apr. 4, 2000

[54] EXTENDED NIP PRESS APPARATUS

[75] Inventor: Richard Alheid, Williams Bay, Wis.

[73] Assignee: Beloit Technologies, Inc., Wilmington, Del.

[21] Appl. No.: 09/089,690

[22] Filed: Jun. 3, 1998

[51] Int. Cl.[7] ..... D21F 3/02

[52] U.S. Cl. ..... 162/358.3; 100/153; 162/361

[58] Field of Search ..... 162/358.3, 361; 100/153

[56] References Cited

U.S. PATENT DOCUMENTS

| | | | |
|---|---|---|---|
| 4,485,540 | 12/1984 | Riihinen | 492/7 |
| 4,704,191 | 11/1987 | Wedel | 162/358.3 |
| 4,923,570 | 5/1990 | Steiner et al. | 162/358.3 |
| 4,948,467 | 8/1990 | Creagan | 162/358.3 |
| 5,441,604 | 8/1995 | Sandberg | 162/358.3 |
| 5,496,442 | 3/1996 | Laapotti | 162/358.3 |

*Primary Examiner*—Karl M. Hastings
*Attorney, Agent, or Firm*—Lathrop & Clark LLP

[57] ABSTRACT

An extended nip press apparatus is disclosed for pressing a web of paper. The apparatus includes a press which defines a concave surface. A backing roll cooperates with the concave surface for defining therebetween an extended nip pressing section. A looped bearing blanket slidably cooperates with the concave surface, the blanket being disposed between the press shoe and the backing roll for supporting guiding the web through the pressing section. An electromagnetic unit drivingly cooperates with the shoe, the arrangement being such that when the electromagnetic is energized, the shoe is electromagnetically urged near the backing roll for pressing the web. The electromagnetic includes plurality of electromagnetic units disposed in a cross-machine direction so that each unit when energized exerts a force on the shoe for urging the shoe towards the backing roll. A control arrangement controls the force exerted by each unit.

8 Claims, 3 Drawing Sheets

EXTENDED NIP PRESS APPARATUS

BACKGROUND OF THE INVENTION

1. Field of the Invention

The present invention relates to an extended nip press apparatus for pressing a web of paper.

More specifically, the present invention relates to an electromagnetic extended nip press apparatus for pressing a web of paper.

INFORMATION DISCLOSURE STATEMENT

In the papermaking art, a formed web of paper is transferred from a forming section into a press section for pressing water from the formed web.

A typical extended nip press includes an elongate pressing shoe having a concave surface which cooperates with a backing roll for defining therebetween an extended nip. A looped bearing blanket slidably extends through the pressing section for guiding and supporting the formed web through the extended nip. The extended nip exerts pressure on the web and the residence time of the web within the extended nip is greater than the residence time of a web extending through a nip defined between a pair of cooperating rolls.

However, a typical extended nip press has a cross-machine directional width of at least 30 foot. Consequently, rather complex control means are required in order to assure that the pressure applied to the web along the width of the web is maintained constant. In the prior art, such deflection of the backing roll in a cross-machine direction is controlled by the provision of a plurality of hydraulic pistons which are controlled in order to compensate for the tendency of the backing roll to bow during the pressing operation.

The present invention overcomes the aforementioned complications of the prior art arrangements by the provision of a plurality of electromagnetic units disposed in a cross-machine direction for controllably applying pressure on a web extending through an extended nip pressing section.

Other objects and advantages of the present invention will be readily apparent to those skilled in the art by consideration of the detailed description contained hereinafter taken in conjunction with the annexed drawings.

SUMMARY OF THE INVENTION

The present invention relates to an extended nip press apparatus for pressing a web of paper. The apparatus includes a press shoe which defines a concave surface. A backing roll cooperates with a concave surface for defining therebetween an extended nip pressing section. A looped bearing blanket slidably cooperates with the concave surface and is disposed between the shoe and the backing roll for supporting and guiding the web through the pressing section.

Electromagnetic means drivingly cooperate with the shoe. The arrangement is such that when the electromagnetic means are energized, the shoe is electromagnetically urged towards the backing roll for pressing the web. The electromagnetic means includes a plurality of electromagnetic units which are disposed in a cross-machine direction so that each unit when energized exerts a force on the shoe for urging the shoe towards the backing roll.

Control means are provided for controlling the force exerted by each unit.

In one embodiment of the present invention, the shoe is a hydrodynamic shoe and in another embodiment of the present invention the press shoe is a hydrostatic shoe.

In a preferred embodiment of the present invention, the backing roll is fabricated from iron.

The looped bearing blanket is vented and is preferably an enclosed blanket which encloses the shoe such that any lubrication supplied between the blanket and the shoe is contained within the blanket.

Each of the electromagnetic units include a ferrite bar rigidly secured to the press shoe and an electromagnetic coil wound around the ferrite bar so that when the coil is energized, the ferrite bar and shoe secured thereto is urged towards the backing roll.

The control means includes a control circuit for individually controlling the energizing of each unit so that the force asserted by each unit is controlled.

Many variations and modifications of the present invention will be readily apparent to those skilled in the art by consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
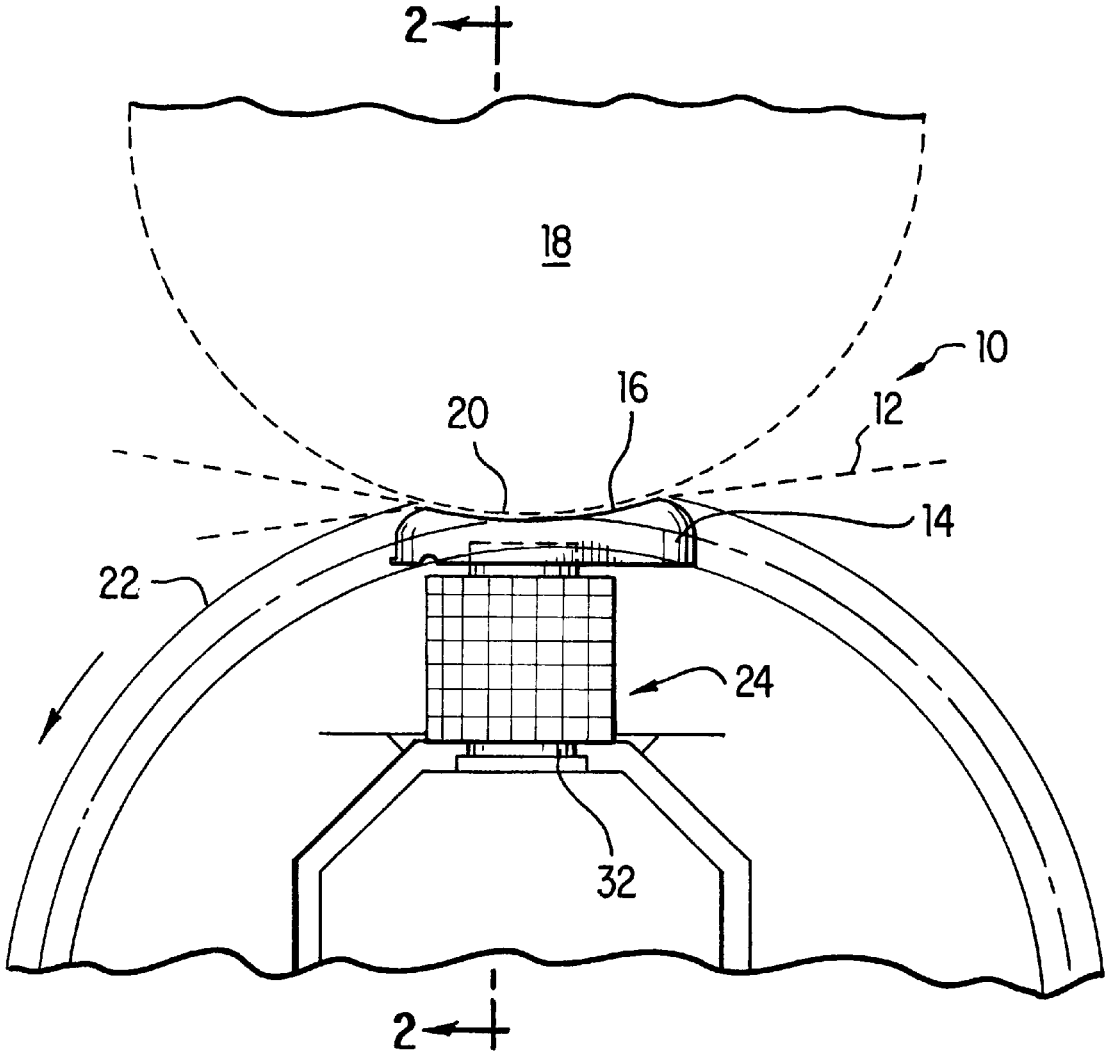
FIG. 1 is a side elevational view of an extended nip press apparatus according to the present invention.

FIG. 1 is a side elevation view of an extended nip press apparatus generally designated 10 according to the present invention for pressing a web 12 of paper. The apparatus 10 includes a press shoe 14 which defines a concave surface 16. A backing roll 18 cooperates with the concave surface 16 for defining therebetween an extended nip pressing section 20.

A looped bearing blanket 22 slidably cooperates with the concave surface 16. The blanket 22 is disposed between the press shoe 14 and the backing roll 18 for supporting and guiding the web 12 through the pressing section 20.

Electromagnetic means generally designated 24 drivingly cooperate with the shoe 14. The arrangement is such that when the electromagnetic means 24 is energized, the shoe 14 is electromagnetically urged towards the backing roll 18 for pressing the web 12.

Figure 2:
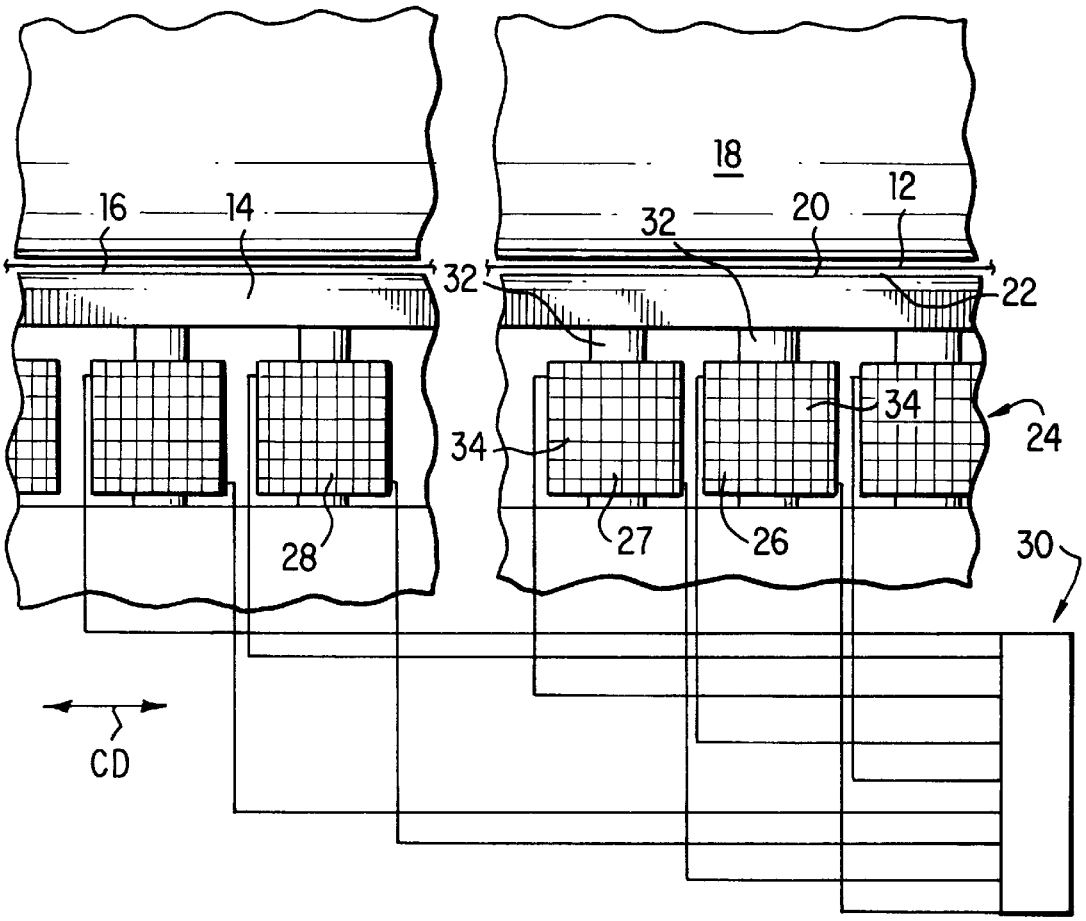
FIG. 2 is a sectional view taken on the line 2—2 of FIG. 1.

FIG. 2 is a view taken on the section 2—2 of FIG. 1.

FIG. 2 shows the elect romagnetic means 24 includes a plurality of electromagnetic units 26, 27 and 28 which are disposed in a cross-machine direct ion as indicated by the arrow CD so that each unit 26–28 when energized exerts a force on the shoe 14 for urging the shoe 14 towards the backing roll 18. As illustrated, the units 26, 27, and 28 have a bearing surface of a first dimension in the cross-machine direction and the bearing surfaces of adjacent electromagnetic units are spaced apart by a second dimension in the cross-machine direction, which is larger than the first dimension.

Control means generally designated 30 is provided for controlling the force exerted by each unit 26–28.

In one embodiment of the present invention as shown in FIG. 1, the press shoe 14 is a hydrodynamic shoe.

Figure 3:
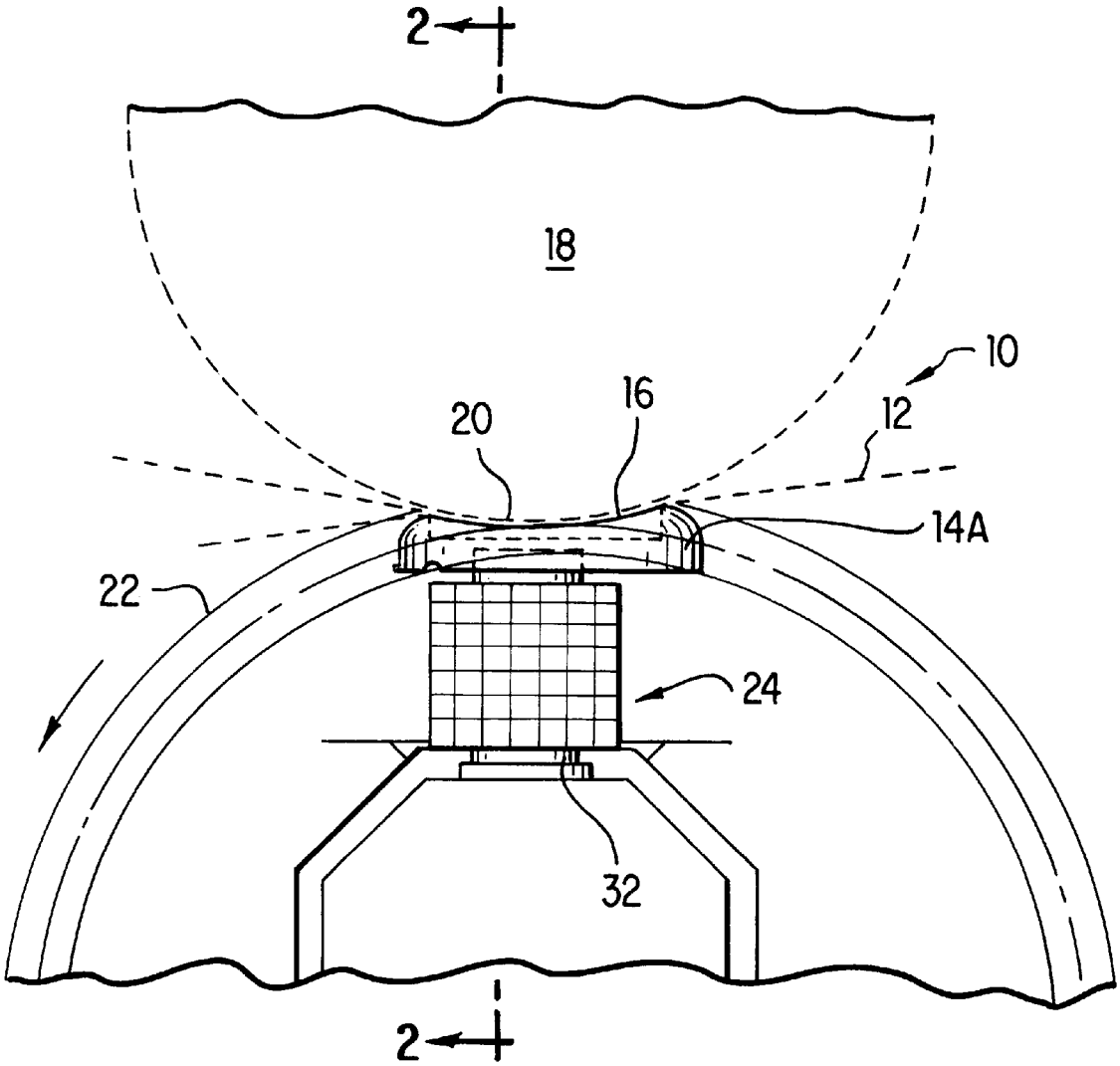
FIG. 3 is a similar view to that shown in FIG. 1 but shows the shoe as a hydrostatic shoe.

The embodiment shown in FIG. 3, includes a press shoe 14*a* which is a hydrostatic shoe.

As shown in FIG. 1, in a preferred embodiment of the present invention, the backing roll 18 is fabricated from iron.

Additionally, the looped bearing blanket 22 is vented and is preferably a looped bearing blanket which encloses the press shoe 14 such that any lubrication supplied between the blanket 22 and the shoe 14 is contained within the blanket 22.

As shown in FIG. 1, each of the electromagnetic units 26–28 includes a ferrite bar 32 which is rigidly secured to the press shoe 14 and an electromagnetic coil 34 which is wound around the ferrite bar 32 so that when the coil 34 is energized, the ferrite bar 32 and shoe 14 secured thereto is urged towards the backing roll 18.

The control means 30 as shown in FIG. 1, includes a control circuit for individually controlling and energizing each unit 26–28 so that the force exerted by each unit 26–28 is controlled.

The present invention provides a simplified extended nip press which provides an accurate means for controlling the profile of a pressed web.

What is claimed is:

1. An extended nip press apparatus for pressing a web of paper, said apparatus comprising:

a press shoe defining a concave surface;

a backing roll cooperating with said concave surface for defining therebetween an extended nip pressing section;

a looped bearing blanket slidably cooperating with said concave surface, said blanket being disposed between said press shoe and said backing roll for supporting and guiding the web through said pressing section;

electromagnetic means drivingly cooperating with said shoe, the arrangement being such that when said electromagnetic means is energized, said shoe is electromagnetically urged towards said backing roll for pressing the web;

said electromagnetic means including:

a plurality of electromagnetic units disposed in a cross-machine direction so that each unit when energized exerts a force on said shoe for urging said shoe towards said backing roll, wherein each electromagnetic unit includes a ferrite bar devoid of any coil recesses and having a bearing surface of a first dimension in the cross-machine direction, the ferrite bar bearing surfaces of adjacent electromagnetic units are spaced apart by a second dimension in the cross-machine direction, which is larger than the first dimension, and each said ferrite bar is rigidly secured to said press shoe;

an electromagnetic coil wound around said ferrite bar so that when said coil is energized, said ferrite bar and shoe secured thereto are urged towards said backing roll; and control means for controlling the force exerted by each unit.

2. An extended nip press apparatus as set forth in claim 1 wherein:

said press shoe is a hydrodynamic shoe.

3. An extended nip press apparatus as set forth in claim 1 wherein:

said press shoe is a hydrostatic shoe.

4. An extended nip press apparatus as set forth in claim 1 wherein:

said backing roll is fabricated from iron.

5. An extended nip press apparatus as set forth in claim 1 wherein:

said looped bearing blanket is vented.

6. An extended nip press apparatus as set forth in claim 1 wherein:

said looped bearing blanket is an enclosed blanket which encloses said press shoe such that lubrication supplied between said blanket and said shoe is contained within said blanket.

7. An extended nip press apparatus as set forth in claim 1 wherein:

said control means includes:

a control circuit for individually controlling the energizing of each unit so that the force exerted by each unit is controlled.

8. An extended nip press apparatus for pressing a web of paper, said apparatus comprising:

a press shoe defining a concave surface;

a backing roll cooperating with said concave surface for defining therebetween an extended nip pressing section;

a looped bearing blanket slidably cooperating with said concave surface, said blanket being disposed between said press shoe and said backing roll for supporting and guiding the web through said pressing section;

electromagnetic means drivingly cooperating with said shoe, the arrangement being such hat when said electromagnetic means is energized, said shoe is electromagnetically urged towards said backing roll for pressing the web;

said electromagnetic means including:

a plurality of electromagnetic units disposed in a cross-machine direction so that each unit when energized exerts a force on said shoe for urging said shoe towards said backing roll;

control means for controlling the force exerted by each unit; and each of said electromagnetic units including:

a ferrite bar having a bearing surface of a first dimension in the cross-machine direction, said ferrite bar connected to said press shoe;

an electromagnetic coil wound around said bar so that when said coil is energized, said bar and shoe are urged towards said backing roll, wherein the ferrite bar bearing surfaces of adjacent electromagnetic units are spaced apart a second cross-machine dimension, which is greater than the first dimension.

* * * * *